US010668750B2

(12) United States Patent
Kodama et al.

(10) Patent No.: US 10,668,750 B2
(45) Date of Patent: Jun. 2, 2020

(54) TAPE CARTRIDGE WITH IMPROVED RUNNING STABILITY WHEN CONVEYING FABRIC TAPE

(71) Applicant: BROTHER KOGYO KABUSHIKI KAISHA, Nagoya-shi, Aichi (JP)

(72) Inventors: Akiko Kodama, Nagakute (JP); Hisako Tonishi, Aichi-ken (JP); Keisuke Nishihara, Nagoya (JP)

(73) Assignee: BROTHER KOGYO KABUSHIKI KAISHA, Nagoya-shi, Aichi (JP)

( * ) Notice: Subject to any disclaimer, the term of this patent is extended or adjusted under 35 U.S.C. 154(b) by 0 days.

(21) Appl. No.: 16/137,679

(22) Filed: Sep. 21, 2018

(65) Prior Publication Data

US 2019/0023038 A1 Jan. 24, 2019

Related U.S. Application Data

(63) Continuation of application No. PCT/JP2017/011745, filed on Mar. 23, 2017.

(30) Foreign Application Priority Data

Mar. 25, 2016 (JP) ..... 2016-061790

(51) Int. Cl.
*B41J 11/70* (2006.01)
*B41J 15/04* (2006.01)
(Continued)

(52) U.S. Cl.
CPC ..... *B41J 15/044* (2013.01); *B41J 3/4078* (2013.01); *B41J 11/70* (2013.01); *B41J 17/32* (2013.01); *B41J 35/28* (2013.01)

(58) Field of Classification Search
CPC . B41J 3/4078; B41J 11/70; B41J 17/32; B41J 35/28; B41J 15/044
See application file for complete search history.

(56) References Cited

U.S. PATENT DOCUMENTS

2002/0012558 A1 1/2002 Huss et al.
2006/0198680 A1 9/2006 Yamamoto et al.
(Continued)

FOREIGN PATENT DOCUMENTS

CN 1135417 A 11/1996
CN 1827386 A 9/2006
(Continued)

OTHER PUBLICATIONS

International Search Report dated Jun. 13, 2017 issued in PCT/JP2017/011745.
(Continued)

*Primary Examiner* — Lamson D Nguyen
(74) *Attorney, Agent, or Firm* — Scully, Scott, Murphy & Presser, P.C.

(57) ABSTRACT

A tape cartridge includes a casing, a tape roll, and a ribbon roll. The casing has a tape outlet. The tape roll is formed by winding a fabric tape. The ribbon roll is formed by winding an ink ribbon. The tape outlet is formed at a most downstream end of a tape conveying path of the fabric tape paid out from the tape roll. The fabric tape is discharged through the tape outlet outside. The fabric tape includes a heat cutter processed parts, and a printing part. The heat cutter processed parts are positioned at each end portion in a widthwise direction of the fabric tape. The printing part is positioned between the heat cutter processed parts. The fabric tape is in contact with an outer circumferential part of the ribbon roll on a way of conveying the fabric tape along the tape conveying path to the tape outlet.

8 Claims, 13 Drawing Sheets

(51) Int. Cl.

| | |
|---|---|
| ***B41J 35/28*** | (2006.01) |
| ***B41J 3/407*** | (2006.01) |
| ***B41J 17/32*** | (2006.01) |

(56) References Cited

U.S. PATENT DOCUMENTS

| | | | |
|---|---|---|---|
| 2007/0086821 | A1 | 4/2007 | Suzuki et al. |
| 2010/0247209 | A1 | 9/2010 | Yamaguchi et al. |
| 2014/0307038 | A1 | 10/2014 | Niizeki et al. |

FOREIGN PATENT DOCUMENTS

| | | | |
|---|---|---|---|
| CN | 102361760 | A | 2/2012 |
| EP | 0 567 978 | A2 | 11/1993 |
| EP | 2 792 496 | A1 | 3/2014 |
| JP | H04-133756 | A | 5/1992 |
| JP | H05-016342 | U | 3/1993 |
| JP | H07-132625 | A | 5/1995 |
| JP | 2001-207358 | A | 8/2001 |
| JP | 2003-506235 | A | 2/2003 |
| JP | 2007-111863 | A | 5/2007 |
| JP | 2012-153106 | A | 8/2012 |
| JP | 2015-063045 | A | 4/2015 |

OTHER PUBLICATIONS

Translation of International Preliminary Report on Patentability and Written Opinion dated Oct. 4, 2018 issued in PCT/JP2017/011745.
Extended European Search Report dated Oct. 10, 2019 from related EP 17770354.3.
Chinese Office Action dated Nov. 1, 2019 received in Chinese Application No. 201780018779.1, together with an English-language translation.

TAPE CARTRIDGE WITH IMPROVED RUNNING STABILITY WHEN CONVEYING FABRIC TAPE

CROSS REFERENCE TO RELATED APPLICATION

This application is a by-pass continuation application of International Application No. PCT/JP2017/011745 filed Mar. 23, 2017 in the Japan Patent Office acting as Receiving Office and claiming priorities from Japanese Patent Application No. 2016-061790 filed Mar. 25, 2016. The entire contents of the International application and the Japanese Patent application are incorporated herein by reference.

TECHNICAL FIELD

The present invention relates to a tape cartridge housing a fabric tape.

BACKGROUND

There is conventionally known tape cartridge that accommodate tape used for printing as described in Japanese Unexamined Patent Application Publication No. 1992-133756. The tape cartridge (ribbon cassette) described in the Japanese Unexamined Patent Application Publication has a case, a printing tape spool rotatably accommodated in the case, tape (printing tape) wound about the printing tape spool to form a tape roll, a ribbon feed spool rotatably accommodated in the case, and ink ribbon wound about the ribbon feed spool. Tape drawn from the tape roll is conveyed along a tape-conveying path inside the case and discharged from the case through a tape outlet provided in the case at the downstream end of the tape-conveying path.

SUMMARY

In recent years, there have been an increasing number of proposals for using fabric tape as the printing tape in tape cartridges. This fabric tape is formed by weaving a first thread (e.g., a warp) and a second thread (e.g., a weft), producing an uneven surface profile with low conveying resistance. Consequently, new measures are required to ensure running stability when conveying this fabric tape. Specific considerations for this issue have not been addressed in the conventional technology described above.

In view of the foregoing, it is an object of the present invention to provide a tape cartridge capable of improving running stability when conveying fabric tape.

In order to attain the above and other objects, according to one aspect, the disclosure provides a tape cartridge including a casing, a tape roll, and a ribbon roll. The casing has a tape outlet. The tape roll formed by winding a fabric tape and is rotatably accommodated in the casing. The ribbon roll is formed by winding an ink ribbon and is rotatably accommodated in the casing. The tape outlet is formed at a most downstream end of a tape conveying path of the fabric tape discharged from the tape roll. The fabric tape is discharged through the tape outlet outside of the casing. The fabric tape includes a heat cutter processed parts, and a printing part. The heat cutter processed parts are positioned at each end portion in a widthwise direction of the fabric tape. The printing part is positioned between the heat cutter processed parts. The fabric tape is in contact with an outer circumferential part of the ribbon roll on a way of conveying the fabric tape along the tape conveying path to the tape outlet.

According to another aspect, the disclosure provides a tape cartridge including a casing, a tape roll, a ribbon roll, and a guide member. The tape roll includes a tape spool and a fabric tape wound over the tape spool. The tape roll is rotatably accommodated in the casing. The ribbon roll includes a ribbon spool and an ink ribbon wound over the ribbon spool. The ribbon roll is rotatably accommodated in the casing. The guide member is provided on an outer circumferential side of the ribbon roll. The fabric tape discharged from the tape roll is guided over the guide member.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
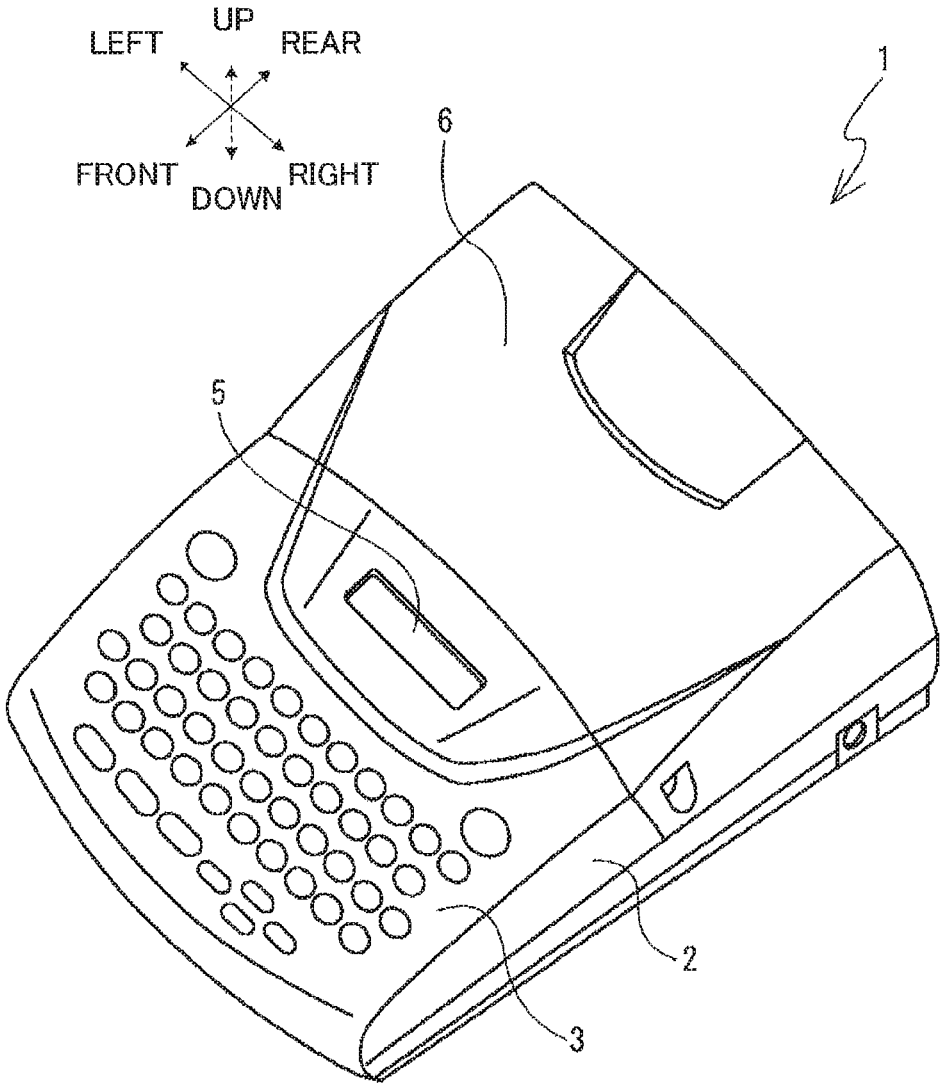
FIG. 1 is a perspective view of a printing device to which a tape cartridge is attached according to an embodiment of the present invention.

Next, a preferred embodiment of the present invention will be described while referring to the accompanying drawings. In the following description of the embodiment, the lower-left side in FIG. 1 is defined as the front side, the upper-right side in FIG. 1 is defined as the rear side, the lower right side in FIG. 1 is defined as the right side, and the upper left side in FIG. 1 is defined as the left side (refer to the directional arrows provided in the drawings).

Overall Structure of a Tape Printing Device

First, the overall structure of a tape printing device in which the tape cartridge of the preferred embodiment is mounted and used will be described. As shown in FIGS. 1 and 2, a tape printing device 1 is provided with a main unit cover 2. The main unit cover 2 has a rectangular shape in a plan view. A keyboard 3 is arranged on the front side of the main unit cover 2. The keyboard 3 includes character keys for alphabetic and numeric characters, symbols, and the like; and various function keys. A liquid crystal display (LCD) 5 is provided on the rear side of the keyboard 3. The LCD 5 can display inputted alphanumeric characters and symbols. A cassette cover 6 is provided on the rear side of the LCD 5. The cassette cover 6 is opened and closed when replacing a tape cartridge 30 (described later with reference to FIG. 3). A cartridge housing section 8 is provided inside the main unit cover 2 in a region corresponding to the cassette cover 6. When the cassette cover 6 is open, a tape cartridge 30 can be freely inserted into and removed from the cartridge housing section 8.

A discharge slit 9 is provided toward the rear on the left side of the main unit cover 2. A printed fabric tape 153' described later is discharged from the main unit cover 2 through the discharge slit 9. A discharge window 11 is also formed on the left side surface of the cassette cover 6. The discharge slit 9 is exposed to the outside of the main unit cover 2 through the discharge window 11 when the cassette cover 6 is in a closed state. A hook-like locking latch 4 is disposed on the bottom surface of the cassette cover 6 in the approximate left-right center and near the front edge thereof. The locking latch 4 protrudes downward from the bottom surface of the cassette cover 6. A latch hole 7 is formed in the main unit cover 2 at a position corresponding to the locking latch 4. The locking latch 4 is fitted into and engaged with the latch hole 7 when the cassette cover 6 is closed, thereby preventing unintentional opening of the cassette cover 6.

Internal Structure of the Main Unit Cover 2

Figure 3:
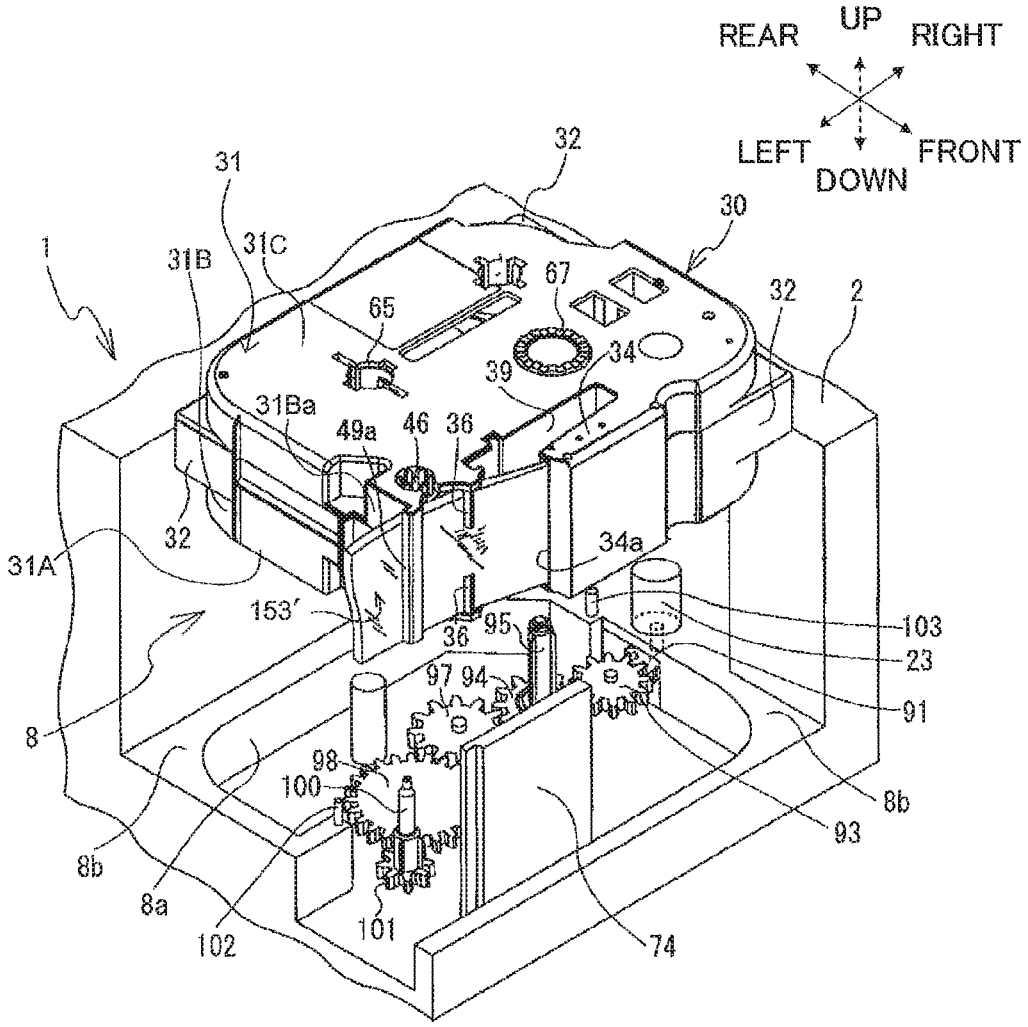
FIG. 3 is a perspective view of the tape cartridge and the cassette housing section to which the tape cartridge is attached.
Figure 4:
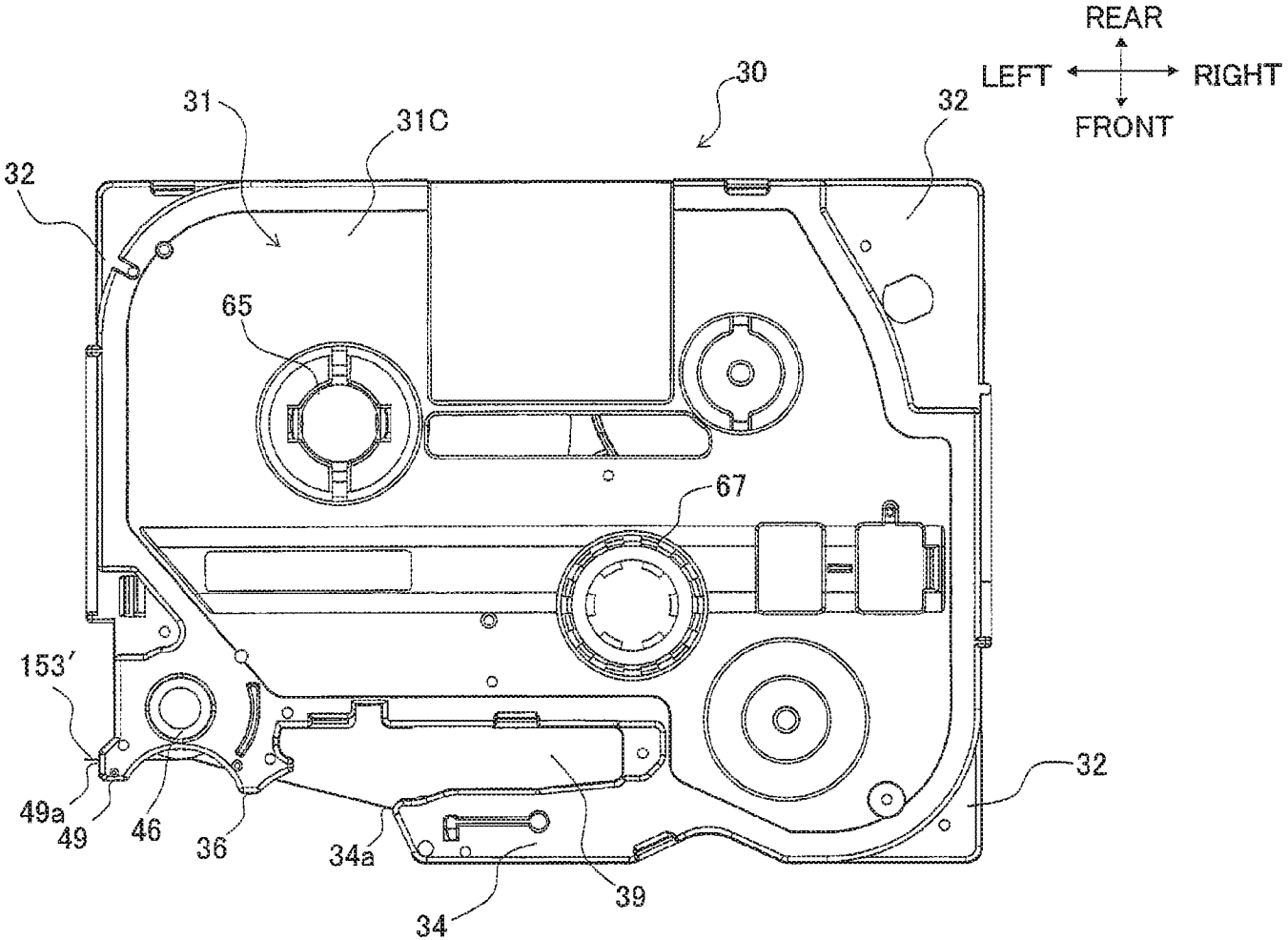
FIG. 4 is a plan view of the tape cartridge.
Figure 5:
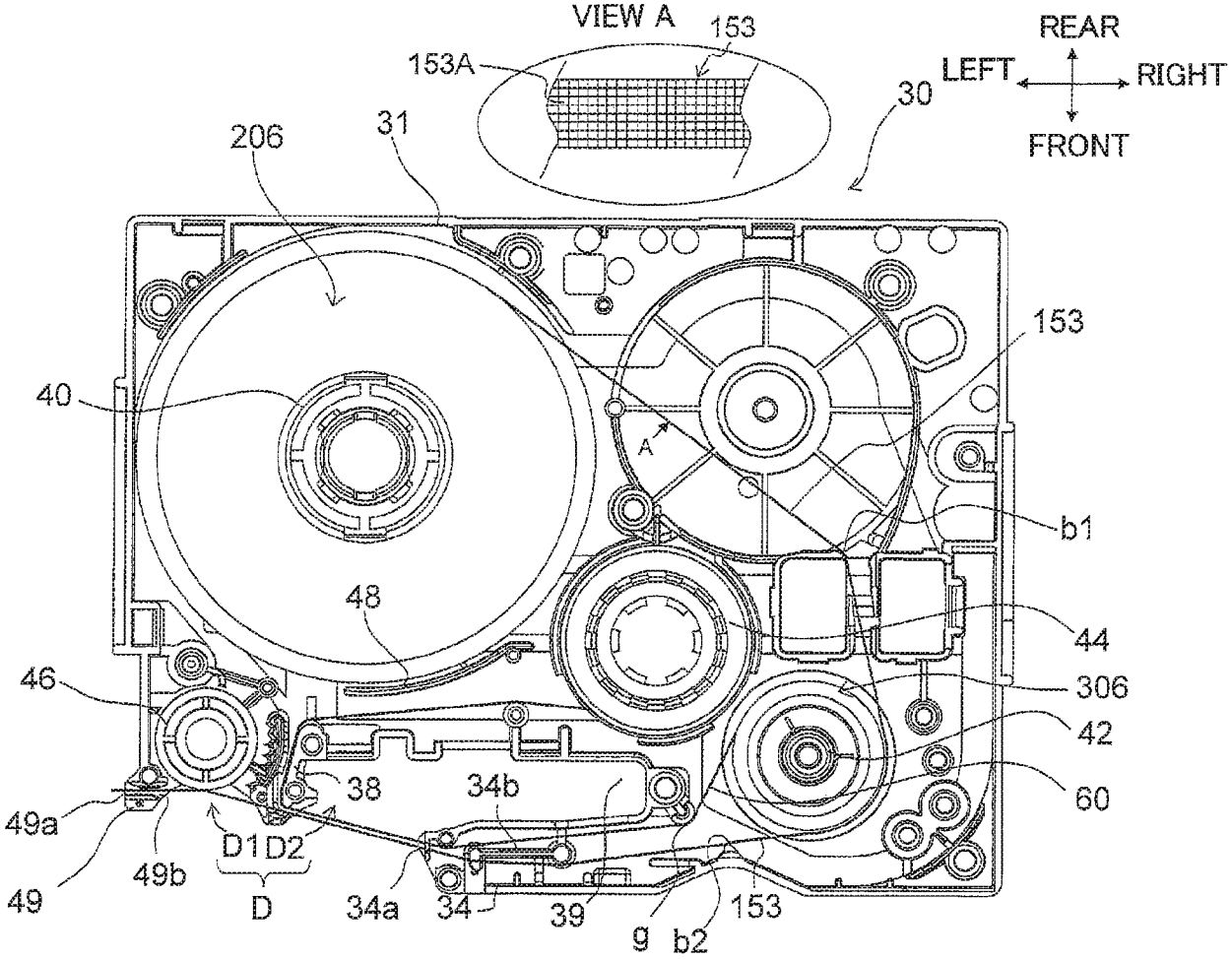
FIG. 5 is a plan view illustrating an internal configuration of the tape cartridge when a top surface of the cartridge case is detached from the cartridge case.

Next, the internal structure of the main unit cover 2 will be described with reference to FIGS. 3, 4, and 5. As shown in FIGS. 3 through 5, the cartridge housing section 8 described above supports a tape cartridge 30 from below when the tape cartridge 30 is inserted into and mounted in the cartridge housing section 8. Specifically, the cartridge housing section 8 supports a bottom surface 31A of a cartridge case 31 (corresponding to the case in the invention) constituting the tape cartridge 30.

Detailed Description of the Tape Cartridge

The tape cartridge 30 has a cartridge case 31 configured in a box-like shape. The cartridge case 31 includes a top surface 31C and a bottom surface 31A provided on the top and bottom sides thereof, and a side surface 31B provided on opposing sides of the cartridge case 31 in horizontal directions orthogonal to the vertical direction. The side surface 31B has a special side surface section 31Ba positioned at the downstream end of a conveying path along which a fabric tape 153 is conveyed after being printed (also called the printed fabric tape 153'). A tape outlet 49*a* (the outlet) is formed in the side surface section 31Ba. The printed fabric tape 153' is discharged from the cartridge case 31 through the tape outlet 49*a*.

A fabric tape 153 configured of a fabric medium (the structure of which will be described later in greater detail) is wound about a tape spool 40. The tape spool 40 is disposed in the left-rear region of the cartridge case 31 so as to be rotatable via a support hole 65 (see FIGS. 3 and 4). Here, the tape spool 40 and the fabric tape 153 wound about the tape spool 40 constitute a tape roll 206. Further, a ribbon spool 42 is rotatably disposed in the right-front region of the cartridge case 31. An ink ribbon 60 is wound around the ribbon spool 42. Here, the ribbon spool 42 and the ink ribbon 60 wound around the ribbon spool 42 constitute a ribbon roll 306.

A ribbon take-up spool 44 is rotatably disposed via a support hole 67 (see FIGS. 3 and 4) in the cartridge case 31 between the tape spool 40 and ribbon spool 42. The ribbon take-up spool 44 draws the ink ribbon 60 off the ribbon spool 42 and takes up the ink ribbon 60 after the ink ribbon 60 has been used for printing characters and the like. A clutch spring (not shown) is attached to the lower portion of the ribbon take-up spool 44 to inhibit slack in the ink ribbon 60 taken up by the ribbon take-up spool 44 by preventing the ribbon take-up spool 44 from rotating in reverse.

An arm part 34 is provided on the front surface of the tape cartridge 30 at the right side thereof. The arm part 34 extends leftward toward the left-right center of the tape cartridge 30, with a gradual forward slope. The fabric tape 153 is drawn off the tape roll 206 and conveyed over bending parts b1 and b2 (see FIG. 5). The ink ribbon 60 is drawn off the ribbon roll 306 and conveyed over a guide roller g. Both the fabric tape 153 and ink ribbon 60 are subsequently guided through the inside of the arm part 34. The gap formed between the inside (rear) surface of the arm part 34 and the front surface of the tape cartridge 30 constitutes a head insertion section 39. When the tape cartridge 30 is mounted in the cartridge housing section 8, the head insertion section 39 is fitted around a head holder 74 that supports a thermal head 10 (described later) in the tape printing device 1. A tape guiding part 34*a* is provided in the distal end of the arm part 34 facing the head insertion section 39. The tape guiding part 34*a* guides the fabric tape 153 and ink ribbon 60 in an adjacent state (or a superimposed state; see FIGS. 10 and 11 described later) into the head insertion section 39.

The fabric tape 153 and the ink ribbon 60 are conveyed in a direction from the tape guiding part 34*a* of the arm part 34 to the tape outlet 49*a*. A support hole (not shown) is provided on the downstream side of the head insertion section 39 in the conveying direction. A tape drive roller 46 is rotatably supported in the support hole. In cooperation with a corresponding movable feed roller (not shown), the tape drive roller 46 draws off and pays out the fabric tape 153 from the tape spool 40. A pair of upper and lower regulating members 36 is disposed on the upstream side of the tape drive roller 46. After characters have been printed on the fabric tape 153, the regulating members 36 guide the resulting printed fabric tape 153' from the downstream side of the thermal head 10 toward the tape outlet 49*a* while restricting movement of the printed fabric tape 153' in its width direction. A ribbon guide wall 38 is disposed in an upright state adjacent to the regulating members 36 for separating used ink ribbon 60 that has been conveyed through the head insertion section 39 from the fabric tape 153 and for guiding the used ink ribbon 60 toward the ribbon take-up spool 44. A separating wall 48 is disposed in an upright state between the ribbon guide wall 38 and ribbon take-up spool 44 for inhibiting the used ink ribbon 60 guided along the ribbon guide wall 38 from contacting the fabric tape 153 wound around the tape spool 40.

The tape cartridge 30 is also provided with a contact-process recessed section D on the upstream side of the tape outlet 49*a* in the conveying direction of the fabric tape 153. The contact-process recessed section D provides space for conveying and printing processes on the fabric tape 153. That is, the contact-process recessed section D is configured of a conveying recessed section D1 that allows the movable conveying roller described above (not shown) to contact and convey the fabric tape 153 toward the tape drive roller 46, and a printing recessed section D2 that allows insertion of the thermal head 10.

The tape cartridge 30 is also provided with a tape insertion part 49. The tape outlet 49*a* described above is formed in the downstream side of the tape insertion part 49 along the conveying path. A tape inlet 49*b* facing the contact-process recessed section D described above (and specifically the conveying recessed section D1) is formed in the upstream side of the tape insertion part 49 in the conveying direction. With the tape insertion part 49 having this configuration, the printed fabric tape 153' enters the tape insertion part 49 through the tape inlet 49*b* and exits through the tape outlet 49*a*. On the other hand, the tape guiding part 34*a* described above is provided in a region of the arm part 34 facing the contact-process recessed section D (and specifically the printing recessed section D2). The tape guiding part 34*a* leads the fabric tape 153 discharged from the tape roll 206 and the ink ribbon 60 discharged from the ribbon roll 306 to the contact-process recessed section D (and specifically the printing recessed section D2).

Figure 2:
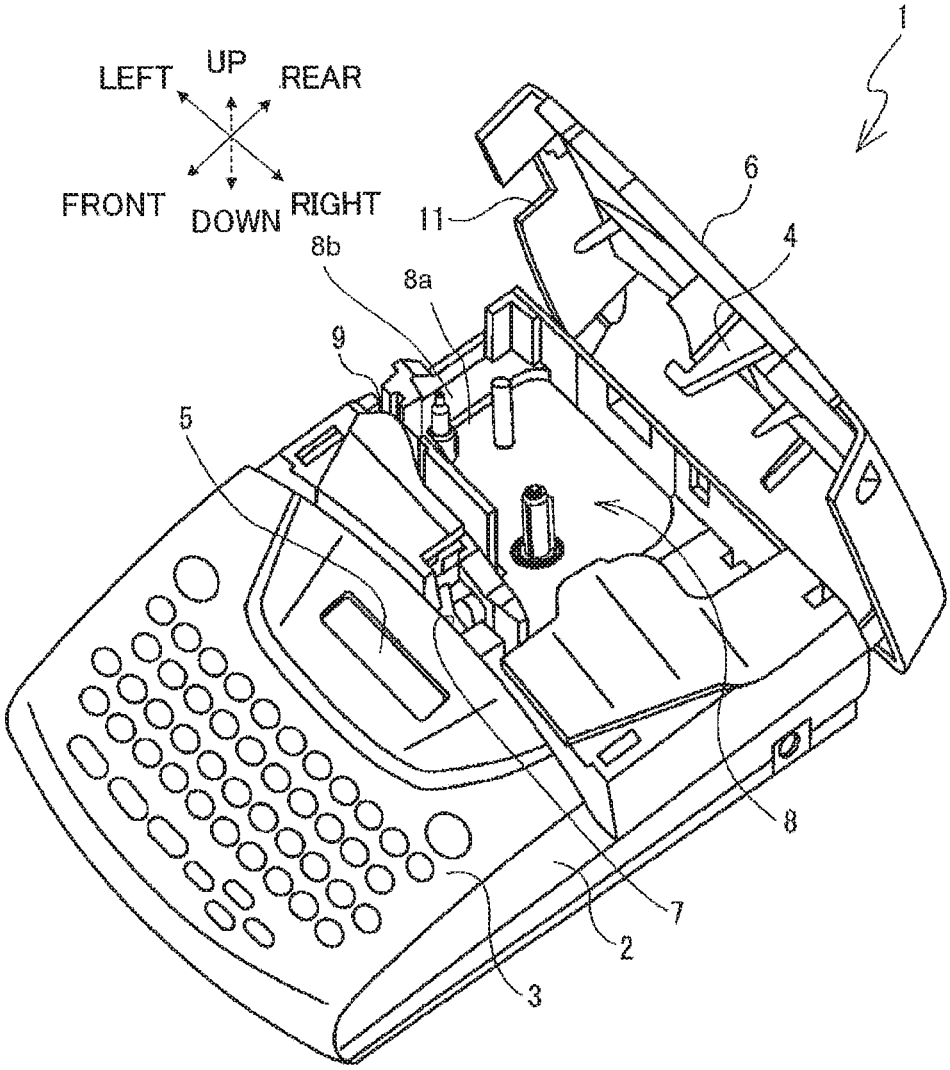
FIG. 2 is a perspective view of the printing device when a cassette cover is in an opened state.

As shown in FIGS. 3 and 4, the cartridge case 31 also has corner parts 32 formed in the vertical center of the cartridge case 31 at prescribed corners (and specifically the corners in which the tape outlet 49*a* is not provided). The corner parts 32 protrude outward from the prescribed corners to form right angles in a plan view. As shown in FIGS. 2 and 3, the cartridge housing section 8 has a recessed part 8*a* that is generally rectangular with rounded corners in a plan view. The flat surfaces extending horizontally from the top edges of the recessed part 8*a* adjacent to the rounded corners are cartridge support parts 8*b* that support the corner parts 32 of the cartridge case 31 from below. In other words, when the tape cartridge 30 is mounted in the cartridge housing section 8, the corner parts 32 are supported from below by the cartridge support parts 8*b*.

Detailed Description of the Cartridge Housing Section

A head holder 74 is fixedly disposed on the front side of the cartridge housing section 8. A thermal head 10 (see FIG. 8 described later) provided with heating elements (not shown) is mounted in the head holder 74. A tape feed motor 23 (see FIG. 3) is arranged on the outer side of the cartridge housing section 8. The tape feed motor 23 is configured of a stepping motor, for example. A drive gear 91 is fixed to the lower end of a drive shaft in the tape feed motor 23. The drive gear 91 is meshed with a gear 93 through an opening penetrating the right wall of the cartridge housing section 8, and the gear 93 is meshed with a gear 94. A ribbon take-up shaft 95 (see FIG. 3) is disposed in an upright state on the top surface of the gear 94. The ribbon take-up shaft 95 drives the ribbon take-up spool 44 in the tape cartridge 30 to rotate. A gear 97 is also meshed with the gear 94, a gear 98 is meshed with the gear 97, and a gear 101 is meshed with the gear 98. A tape drive shaft 100 (see FIG. 3) is disposed in an upright state on the top surface of the gear 101. The tape drive shaft 100 drives the tape drive roller 46 in the tape cartridge 30 to rotate.

When the tape feed motor 23 is driven to rotate in the counterclockwise direction while the tape cartridge 30 is mounted in the cartridge housing section 8, the ribbon take-up shaft 95 is also driven to rotate in the counterclockwise direction via the drive gear 91, gear 93, and gear 94. Since the ribbon take-up shaft 95 is inserted into the ribbon take-up spool 44 described above, the rotation of the ribbon take-up shaft 95 also drives the ribbon take-up spool 44 to rotate. The rotation of the gear 94 is also transmitted to the tape drive shaft 100 via the gear 97, gear 98, and gear 101, thereby driving the tape drive shaft 100 to rotate in the clockwise direction. Since the tape drive shaft 100 is inserted into the tape drive roller 46 of the tape cartridge 30, the rotation of the tape drive shaft 100 drives the tape drive roller 46 to rotate.

A cutting mechanism (not shown) is disposed on the conveying path along which the printed fabric tape 153' is conveyed, i.e., the conveying path from the tape outlet 49*a* of the tape cartridge 30 to the discharge slit 9 described above. The cutting mechanism cuts the printed fabric tape 153' at a prescribed position to form a tape label. The cutting mechanism is configured of a fixed blade, and a movable blade that opposes the fixed blade and that is supported to be capable of moving in the front-rear direction. A cutter motor 24 (see FIG. 8 described later) is provided in the tape printing device 1 for moving the movable blade in the front-rear direction.

Two positioning pins 102 and 103 (see FIG. 3) are provided in the cartridge housing section 8. The positioning pins 102 and 103 are disposed in positions respectively corresponding to two pin holes (not shown) formed in the bottom surface of the tape cartridge 30 when the tape cartridge 30 is mounted in the cartridge housing section 8. The positioning pins 102 and 103 fix the mounted tape cartridge 30 in the proper position in the cartridge housing section 8.

Satin Weave of the Fabric Tape

Next, the fabric tape 153 will be described. The fabric tape 153 is formed by weaving a warp thread (also simply called "warp") extending in the tape longitudinal direction and a weft thread (also simply called "weft") extending in the tape latitudinal direction. In this example, the fabric tape 153 is formed by satin-weaving the warp and weft so that a large amount of the warp ends is exposed on the top surface of the fabric tape 153. That is, a larger amount of warp thread than weft thread is exposed on one side of the fabric tape 153 in the thickness direction thereof. The surface of the medium on this side will be called the printing surface 153A (see FIG. 5).

Figure 6A:
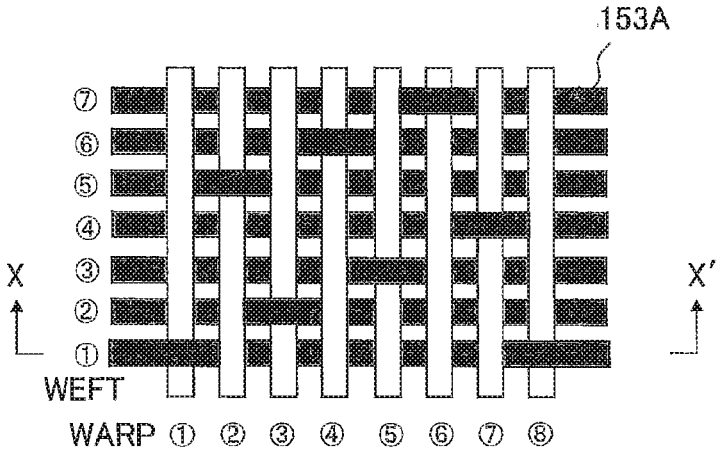
FIG. 6A is a conceptual top view showing a portion of the printing surface.
Figure 6B:
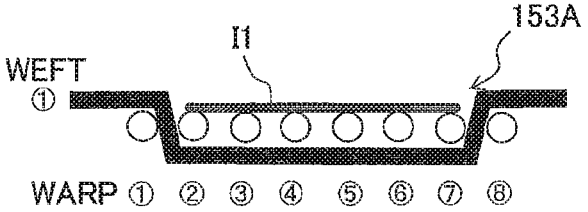
FIG. 6B is a conceptual cross-sectional view along the line X-X' in FIG. 6A.
Figure 6C:
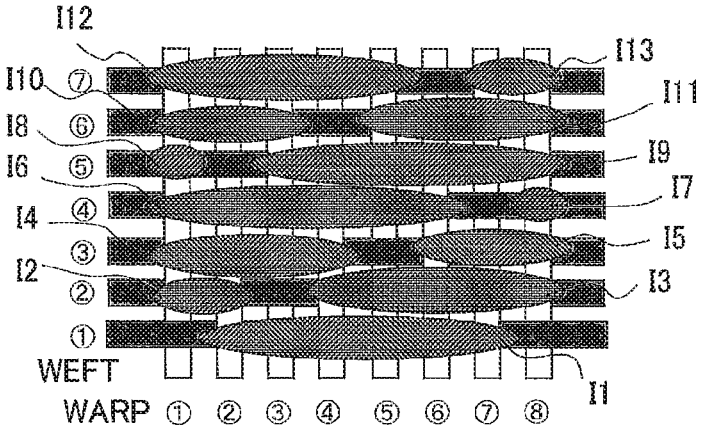
FIG. 6C is an explanatory drawing showing sticking behavior of ink drop to fabric tape.

FIGS. 6(*a*) and 6(*b*) are conceptual drawings showing the details of the satin weave described above forming the printing surface 153A in the preferred embodiment. FIG. 6(*a*) is a conceptual top view showing a portion of the printing surface 153A, and FIG. 6(*b*) is a conceptual cross-sectional view along the line X-X' in FIG. 6(*a*).

As shown in FIGS. 6(*a*) and 6(*b*), the fabric tape 153 of the preferred embodiment is formed of a 7-end satin weave. In the sample region of the printing surface 153A shown in FIG. 6(*a*), eight warp ends (1)-(8) are woven together with seven weft picks (1)-(7).

In this example, warp end (1) is woven under weft pick (1) so as to cross the back side of weft pick (1) (the side opposite the printing surface 153A; this also applies to the remaining description), but is woven over the remaining weft picks (2)-(7) so as to be exposed on the front side (the printing surface 153A; this also applies to the remaining description) at these intersecting points. Similarly, warp end (2) is woven under weft pick (5), but is woven over the remaining weft picks (1)-(4) and (6)-(7) so as to be exposed on the front side at these intersecting points. Warp end (3) is woven under weft pick (2) and over the remaining weft picks (1) and (3)-(7) so as to be exposed on the front side at these intersecting points. Warp end (4) is woven under weft pick (6) and over the remaining weft picks (1)-(5) and (7) so as to be exposed on the front side at these intersecting points. Warp end (5) is woven under weft pick (3) and over the remaining weft picks (1)-(2) and (4)-(7) so as to be exposed on the front side at these intersecting points. Warp end (6) is woven under weft pick (7) and over the remaining weft picks (1)-(6) so as to be exposed on the front side at these intersecting points. Warp end (7) is woven under weft pick (4) and over the remaining weft picks (1)-(3) and (5)-(7) so as to be exposed on the front side at these intersecting points. Warp end (8) is woven under weft pick (1) and over the remaining weft picks (2)-(7) so as to be exposed on the front side at these intersecting points. This weaving configuration in the preferred embodiment results in a relatively low degree of irregularity on the printing surface 153A of the fabric tape 153.

Warp/Weft Weaving Density

In this example, the number of warp ends exposed on the fabric tape 153 can be increased reliably by setting the weaving density of warp ends in the fabric tape 153 relatively high (for example, 300 ends/inch or greater). In particular, the weaving density of ends can be reliably increased by performing the satin weaving process described above with six ends or greater (reducing the number of intersections between the warp ends and weft picks). By increasing the exposure of warp ends in this way, a large number of ink droplets I1-I13 (configured by a transfer layer having a suitable undercoat layer, ink layer, and overcoat layer, for example) can be deposited from the ink ribbon 60 over a wide range in a large number of these exposed areas within the region of the printing surface 153A shown in FIGS. 6(*a*) and 6(*b*), for example, as shown in FIG. 6(*c*). Normally when the fabric medium for the fabric tape 153 is manufactured using a loom, the loom must elaborately separate the warp ends by raising and lowering the ends based on the type of satin weave. Since the fabric tape 153 in this example is configured of a satin weave having ten ends or less, the fabric tape 153 can be reliably manufactured with a loom while avoiding weaves that are too complex.

Further, the weaving density of warp ends in this example is 550 ends/inch or less. This arrangement can avoid the adverse effects of seam slippage in the satin weave or a drop in durability caused by the weaving density of warp ends becoming too great and the warp ends becoming too intricate. Here, the weaving density of weft picks in the fabric tape 153 according to the preferred embodiment is set within a range of 80 picks/inch to 540 picks/inch in order to ensure a smooth weave by conforming with the warp end weaving density ranging between 300 ends/inch and 540 ends/inch.

Calender Process

In order to improve printing quality on the fabric tape 153 according to the preferred embodiment, the printing surface 153A of the fabric tape 153 is subjected to the well-known calender process. The details of this process will be described next with reference to FIG. 7.

Figure 7:
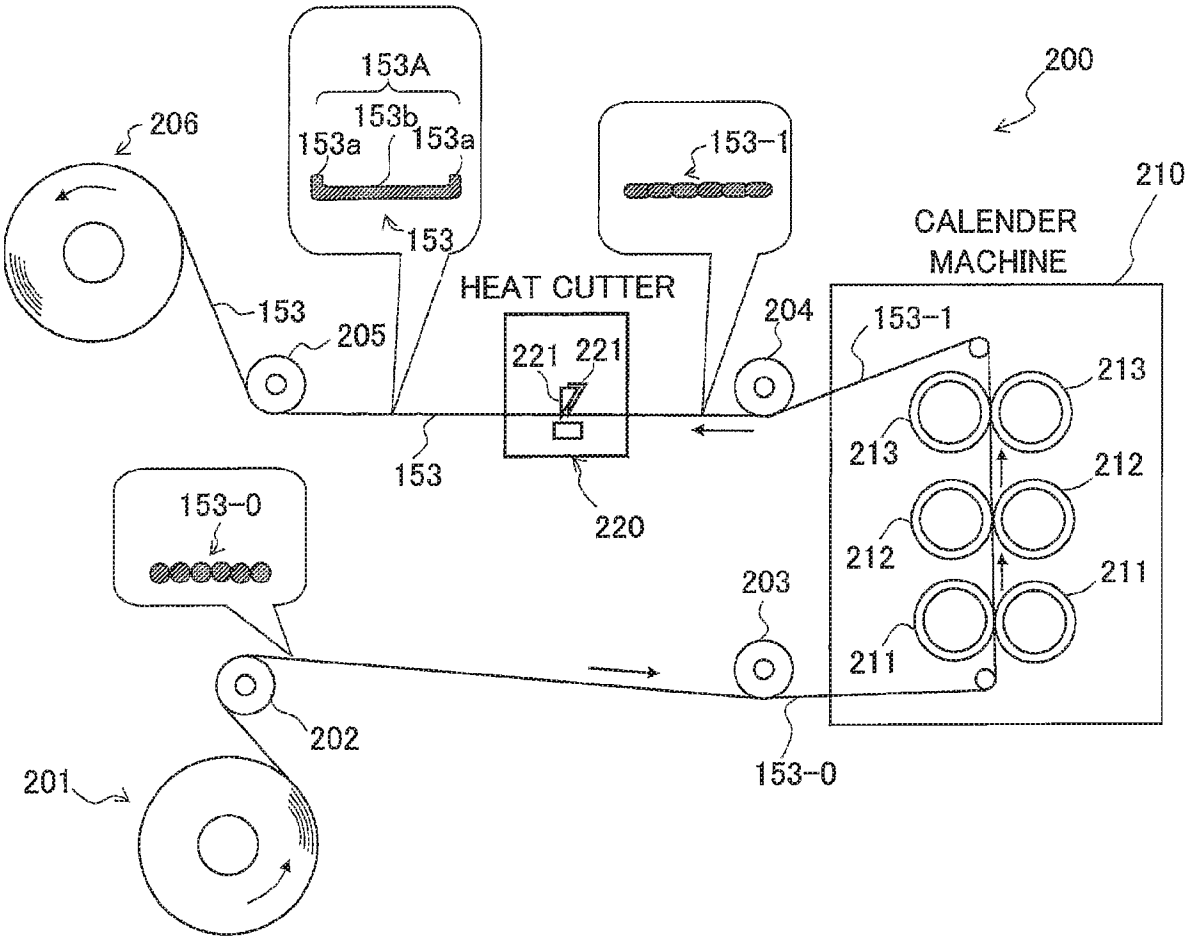
FIG. 7 is an explanatory drawing illustrating manufacturing equipment for manufacturing the fabric tape.

FIG. 7 shows a conceptual configuration of manufacturing equipment 200 for manufacturing the fabric tape 153 described above. In the manufacturing equipment 200 shown in FIG. 7, a raw fabric 153-0 that has not yet undergone the calender process is wound into a supply roll 201. In the preferred embodiment, both the warp and weft used in the raw fabric 153-0 are formed of polyester. The raw fabric 153-0 drawn off the supply roll 201 is introduced into a calender machine 210 through guide rolls 202 and 203.

In this example, the calender machine 210 is provided with a pair of heatable rotary drums 211, a pair of rotary drums 212, and a pair of rotary drums 213. Once introduced into the calender machine 210, the raw fabric 153-0 is conveyed through the calender machine 210 at a prescribed speed while being subjected to heat and pressure by the pairs of rotary drums 211, 212, and 213. This process gives the raw fabric 153-0 a smooth glossy look on at least the side to be the printing surface 153A (on both sides in this example), resulting in a glossy fabric 153-1 (shown in an enlarged view in FIG. 7). As an example of the processing conditions, the calender process is performed with a heating temperature of 160° C. or greater, a conveying speed between 6 and 10 m/min, and a roll pressure of 7 MPa or greater.

The glossy fabric 153-1 emerging from the calender machine 210 is supplied to a heat cutter 220 via a guide roll 204. The heat cutter 220 is provided with a pair of heatable cutting parts 221 on both widthwise sides of the conveying path for the glossy fabric 153-1. In the preferred embodiment, the raw fabric 153-0 (and hence, the glossy fabric 153-1) is configured of a heat-fusible fiber. The fabric tape 153 described earlier is produced by cutting both widthwise edges of the glossy fabric 153-1 with the cutting parts 221 (the heat cutting process). The heat conditions for the cutting parts 221 are 200-600° C., for example, and are preferably 220-500° C. and more preferably 250-400° C. As a result of this process, the printing surface 153A of the fabric tape 153 is configured of two ear parts 153*a* (corresponding to the heat cutter processed parts) positioned along both widthwise edges of the fabric tape 153, and a printing region 153*b* (corresponding to the printing part) positioned in the widthwise center region of the printing surface 153A between the ear parts 153*a*. The discharge window 11 described above prints within the printing region 153*b*.

The fabric tape 153 formed as described above is guided by a guide roll 205 to an original take-up roll 206' and wound about the original take-up roll 206'. As a result of the above process to form the fabric tape 153, the thickness of the warp is between 30 and 90 denier (and preferably between 35 and 80 denier, and more preferably between 40 and 70 denier), and the thickness of the weft is between 30 and 90 denier (and preferably between 40 and 85 denier, and more preferably between 50 and 80 denier). Note that the fabric tape 153 is paid off the original take-up roll 206' and wound about the tape spool 40 (so that the printing surface 153A is facing inward) to be used as the tape roll 206 described above. However, it would also suffice to use the original take-up roll 206' as is, in which case the original take-up roll 206' is formed by winding the fabric tape 153 about the tape spool 40.

Electrical Structure of the Tape Printing Device

Figure 8:
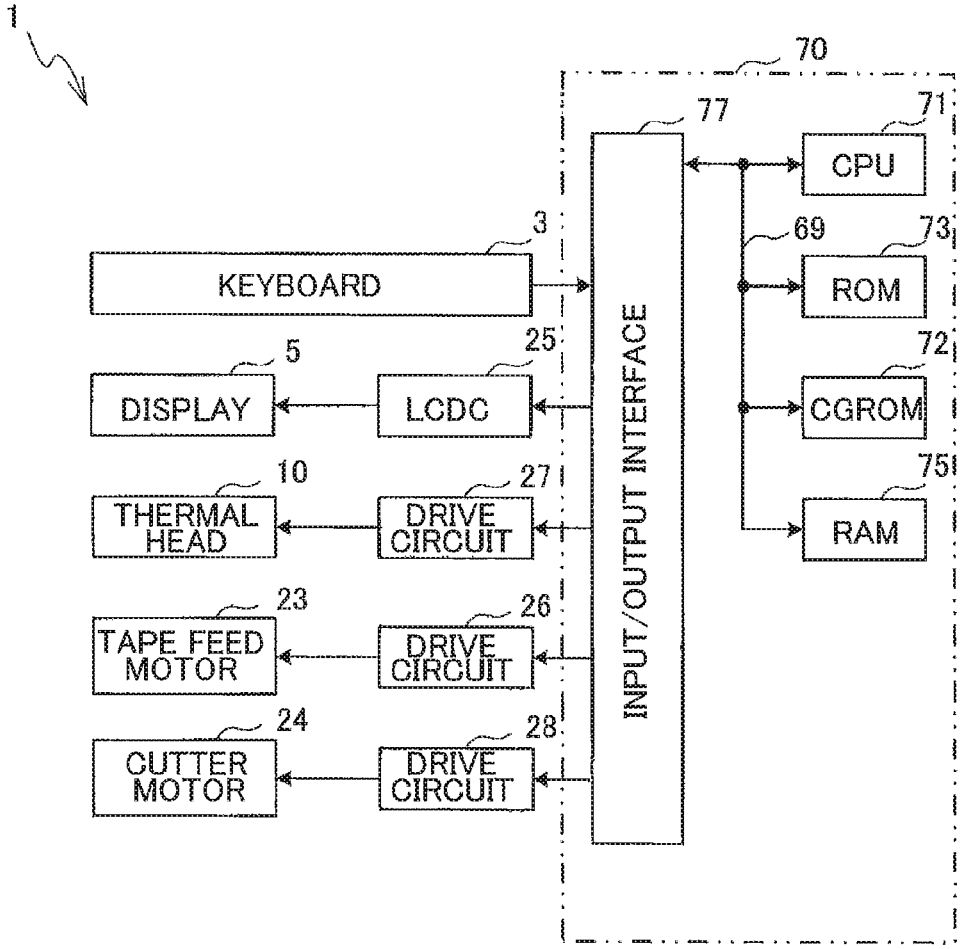
FIG. 8 is a block diagram illustrating an electrical structure of the printing device.

Next, the electrical structure of the tape printing device 1 will be described with reference to FIG. 8. As shown in FIG. 8, the tape printing device 1 is also provided with a control circuit 70 formed on a control board. The control circuit 70 is configured of a CPU 71 for controlling all devices of the tape printing device 1; and a CGROM 72, a ROM 73, a RAM 75, and an input/output interface 77 that are all connected to the CPU 71 via a data bus 69.

Printing dot pattern data is stored in the CGROM 72 for each of multiple characters, including alphanumeric characters and symbols, for the purpose of printing these characters. The printing dot pattern data is sorted according to font (Gothic typeface, Ming typeface, etc.) and stored in association with character code data for six different character sizes (dot sizes 16, 24, 32, 48, 64, and 96, for example) for each of the fonts.

The ROM 74 stores various programs and the like required for controlling the tape printing device 1, including a display drive control program that controls a liquid crystal drive circuit (LCDC) 25 in association with character code data inputted from the keyboard 3 for alphabetic, numeric, and other characters; a print drive control program that controls the thermal head 10 and the tape feed motor 23 described above; a pulse number setting program that sets pulse numbers corresponding to quantities of energy required to form printing dots; and a cutter drive control program that drives the cutter motor 24 described above to cut the printed fabric tape 153' at the prescribed cutting position. The CPU 71 performs various arithmetic operations based on these programs.

The RAM 75 is provided with a text memory, a print buffer, a counter, a total printing dot counter, a parameter storage area, and the like. The text memory stores text data inputted from the keyboard 3. The print buffer stores printing dot patterns for a plurality of alphanumeric characters and the like and pulse numbers equivalent to quantities of energy required for forming dots as dot pattern data. Hence, the thermal head 10 prints dots according to the dot pattern data stored in the print buffer. The counter stores a count value for the number of printing dots in a single line being printed by the thermal head 10. The total printing dot counter stores the total number of dots printed by the thermal head 10 beginning from when the thermal head 10 starts printing. The parameter storage area stores various arithmetic data.

The input/output interface 77 is connected to the keyboard 3 described above, the LCDC 25 that has video RAM (not shown) for outputting display data to the LCD 5, a drive circuit 26 for driving the tape feed motor 23, a drive circuit 27 for driving the thermal head 10, a drive circuit 28 for driving the cutter motor 24, and the like.

Operations of the Tape Printing Device

When a user inputs characters and the like using the keyboard 3 on the tape printing device 1 having the structure described above, this text (text data) is stored in the text memory. Next, dot patterns corresponding to the characters and the like inputted on the keyboard 3 are displayed on the LCD 5 based on the various programs. The drive circuit 27 then drives the thermal head 10 to print dot pattern data stored in the print buffer. The tape feed motor 23 also controls the tape feed in synchronization with the printing operation of the thermal head 10. At this time, the drive circuit 27 selectively heats individual heating elements (not shown) in the thermal head 10 corresponding to the printing dots for one line. As a result of this operation, the characters and the like inputted on the keyboard 3 are printed onto the printing surface 153A of the fabric tape 153, producing the printed fabric tape 153'. The printed fabric tape 153' is conveyed to the cutting position of the cutting mechanism and is cut through the cooperative operations of the movable blade and the fixed blade, producing a tape label (a printed label etc.).

Features of the Embodiment

In the basic structure and operations of the preferred embodiment described above, the most outstanding feature is in the improved conveyance of the fabric tape 153 through the tape cartridge 30. This improvement will be described next in greater detail.

As a result of weaving the warp and weft as described above, the fabric tape 153 has an irregular profile on its woven surface that reduces conveying resistance. Therefore, some measures must be taken to ensure running stability when conveying the fabric tape 153.

Figure 9:
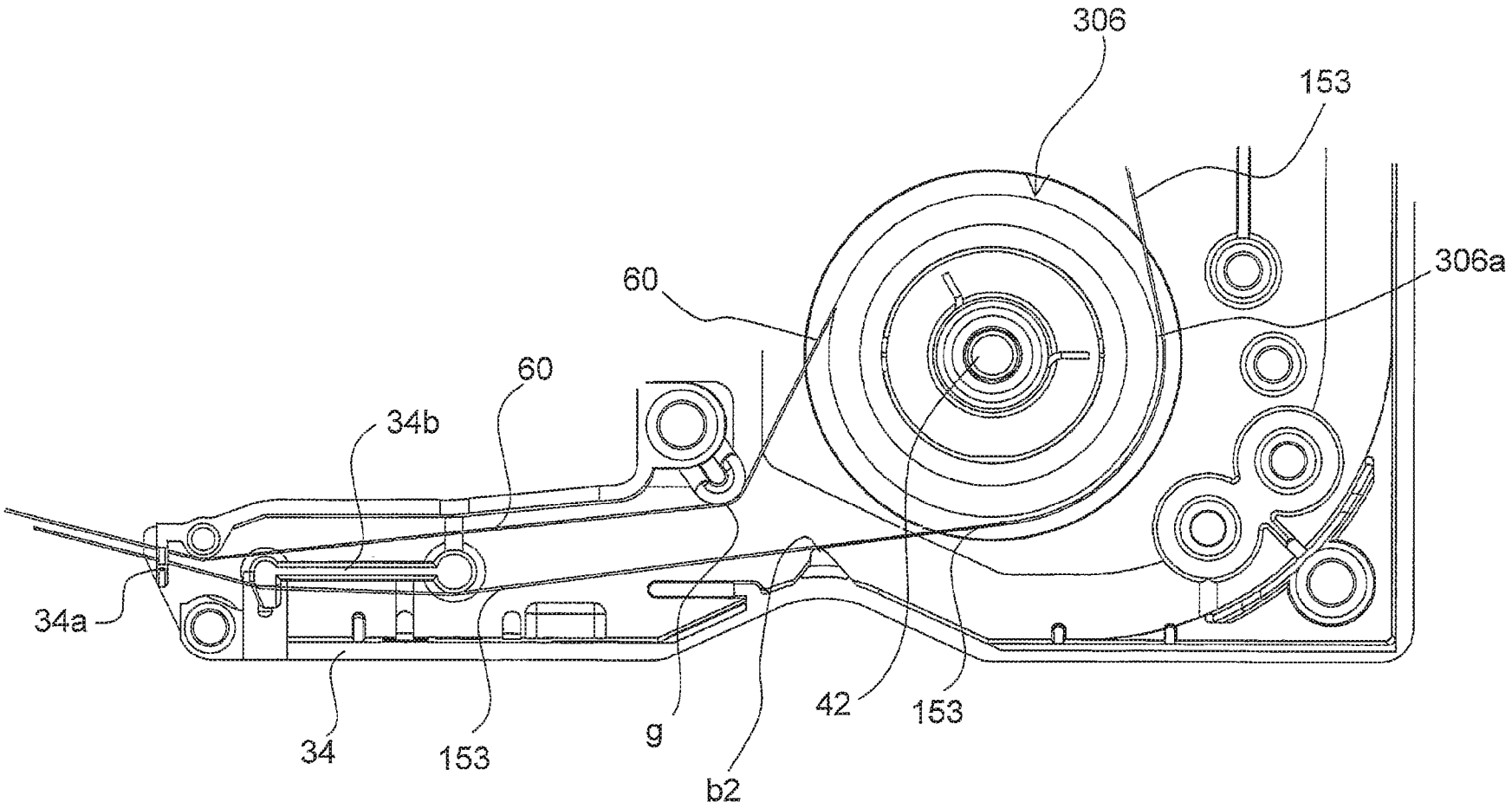
FIG. 9 is an enlarged view of the main part in FIG. 5.

As shown in FIG. 5 and the enlarged view of FIG. 9 for the relevant region, the conveying path of the fabric tape 153 in the preferred embodiment is configured so that the fabric tape 153 comes into contact with an outer circumferential part 306*a* of the ribbon roll 306 at a point midway between the point at which the fabric tape 153 comes off the tape roll 206 and the point at which the fabric tape 153 reaches the tape outlet 49*a*. Note that to illustrate these parts more clearly, FIG. 9 shows a gap formed between the fabric tape 153 and the outer circumferential part 306*a* of the ribbon roll 306.

A partitioning plate 34*b* (corresponding to the separating member) is provided in the arm part 34 on the upstream side (the right side in FIGS. 5 and 9) of the tape guiding part 34*a*. The partitioning plate 34*b* separates the tape conveying path along which the fabric tape 153 is conveyed from the ribbon conveying path along which the ink ribbon 60 is conveyed. As shown in the drawings, the fabric tape 153 is conveyed downstream while kept separated from the ink ribbon 60 by the partitioning plate 34*b*.

According to the preferred embodiment having the structure described above, the fabric tape 153 contacts the outer circumferential part 306*a* of the ribbon roll 306 at a midpoint along its conveying path. Thus, the fabric tape 153 can apply suitable tension to the ribbon roll 306 by contacting the ink ribbon 60 on the outer circumferential part 306*a* of the ribbon roll 306. Further, the Coulomb force (electrostatic force) generated by contact friction between the ribbon roll 306 and fabric tape 153 can restrain the fabric tape 153 from becoming too separated from the ribbon roll 306. This arrangement suppresses slack in the fabric tape 153, maintaining the tape conveying path in the straightest possible shape and preventing the fabric tape 153 from entering excess spaces in the cartridge case 31. Accordingly, this configuration can improve running stability during conveyance and can also suppress the leading end of the fabric tape 153 from being pulled back into the cartridge case 31 from the tape outlet 49*a*.

In addition, friction is generated between the fabric tape 153 and the ribbon roll 306 when the fabric tape 153 contacts the ribbon roll 306. At this time, the ear parts 153*a* formed on the fabric tape 153 in the preferred embodiment can suppress fraying on the widthwise edges of the fabric tape 153 from degrading conveyance and can avoid fibers from being deposited on the ribbon roll 306.

Another particular feature of the embodiment is that the fabric tape 153 is conveyed in a state separated from the ink ribbon 60 owing to the partitioning plate 34*b* disposed upstream of the tape guiding part 34*a*. This arrangement can reduce conveying resistance caused by the ink ribbon 60 contacting and interfering with the fabric tape 153, thereby improving running stability.

Further, in satin weaves with more surface exposure to warp ends than weft picks, the strength (or stiffness) of the fabric tape 153 along the tape conveying path is inherently lacking in this structure, which can result in unstable conveyance. Therefore, the preferred embodiment is particularly effective in improving running stability through the structure described above.

While the invention has been described in detail with reference to specific embodiments thereof, it would be apparent to those skilled in the art that many modifications and variations may be made therein without departing from the spirit of the invention, the scope of which is defined by the attached claims. The following is a description of some possible variations.

(1) Modifying the Tape Conveying Path within the Arm Part

Figure 10:
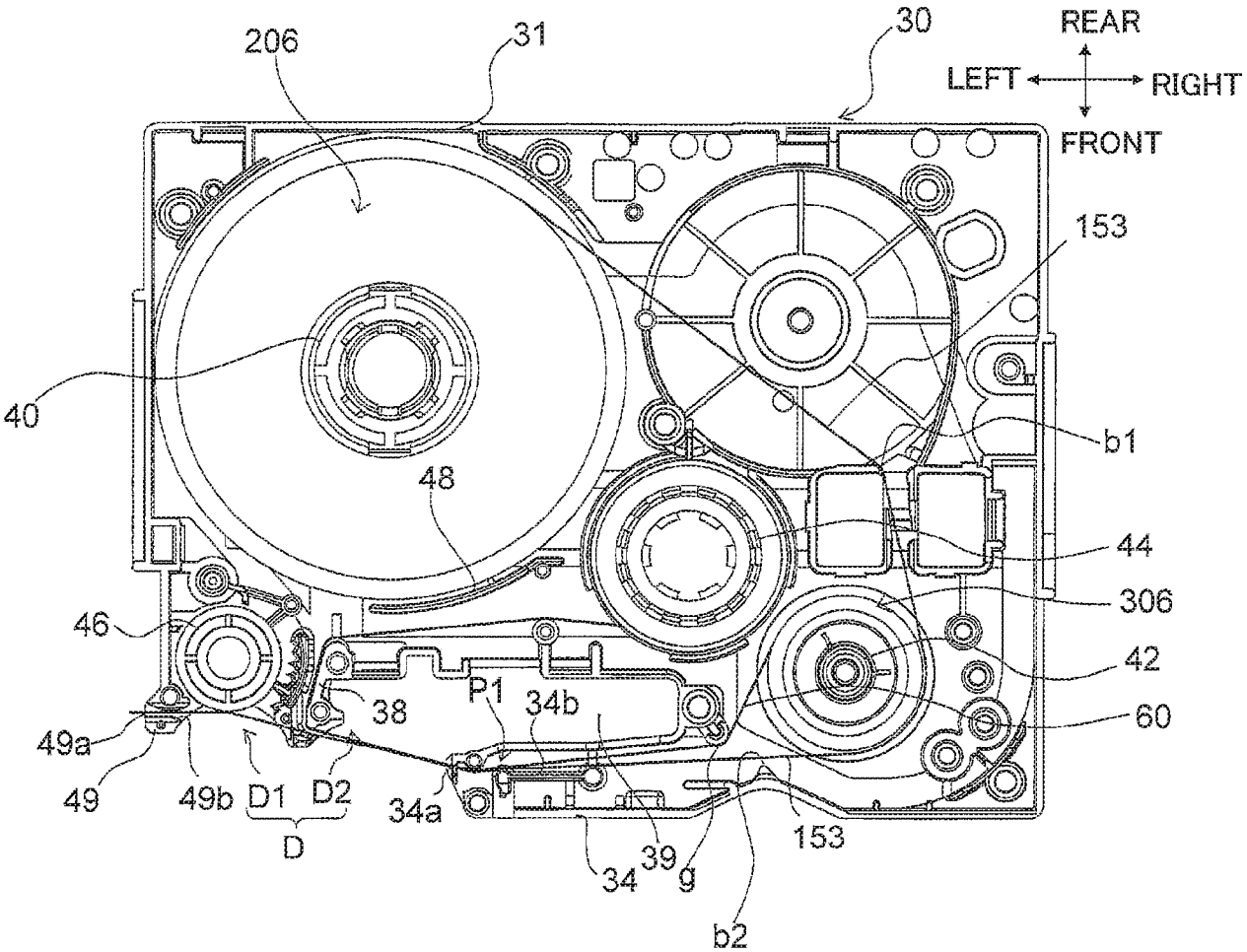
FIG. 10 is a plan view is a plan view illustrating an internal configuration of the tape cartridge according to a variation modifying a tape conveying path within an arm part.
Figure 11:
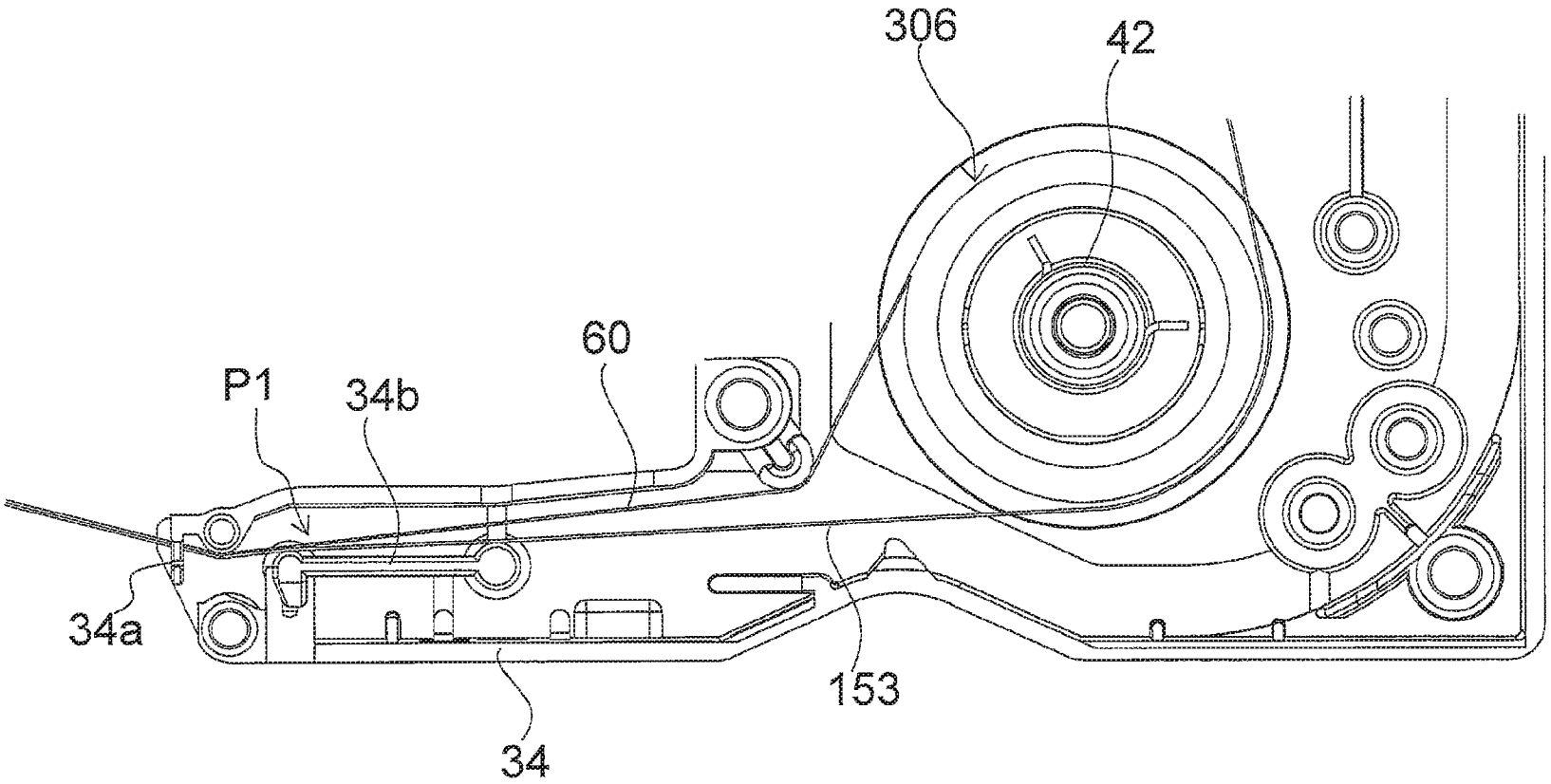
FIG. 11 is an enlarged view of the main part in FIG. 10.

FIG. 10 is an internal structural view of the tape cartridge 30 according to a variation that corresponds to FIG. 5 described above, and FIG. 11 is an enlarged view of the relevant region that corresponds to FIG. 9 described above. As shown in FIGS. 10 and 11, the conveying path of the fabric tape 153 following its point of contact with the outer circumferential part of the ribbon roll 306 passes along the tape roll 206 side of the partitioning plate 34*b* (the same side as the ink ribbon 60). As a result, the fabric tape 153 and ink ribbon 60 are not separated by the partitioning plate 34*b* along their respective conveying paths. The fabric tape 153 converges with the ink ribbon 60 at a prescribed converging point P1 in the arm part 34 on one side of the partitioning plate 34*b*, and the fabric tape 153 and ink ribbon 60 are subsequently guided toward the tape guiding part 34*a* while remaining in contact with each other.

In this variation, the fabric tape 153 is configured to converge with the ink ribbon 60 at the converging point P1, and the fabric tape 153 and ink ribbon 60 are conveyed in contact with each other for a relatively long distance from the converging point P1 to the tape guiding part 34*a*. This arrangement greatly increases the surface area in which the fabric tape 153 and ink ribbon 60 are in contact (increasing the contact surface area by approximately sixfold that in the conventional structure in which the fabric tape and the ink ribbon is contacted with each other), thereby compensating for any lack in strength (i.e., stiffness) in the fabric tape 153 along the tape conveying path. Accordingly, this arrangement can reliably improve running stability.

(2) Providing a Guide Member to Separate the Fiber Tape from the Ribbon Roll

Figure 12:
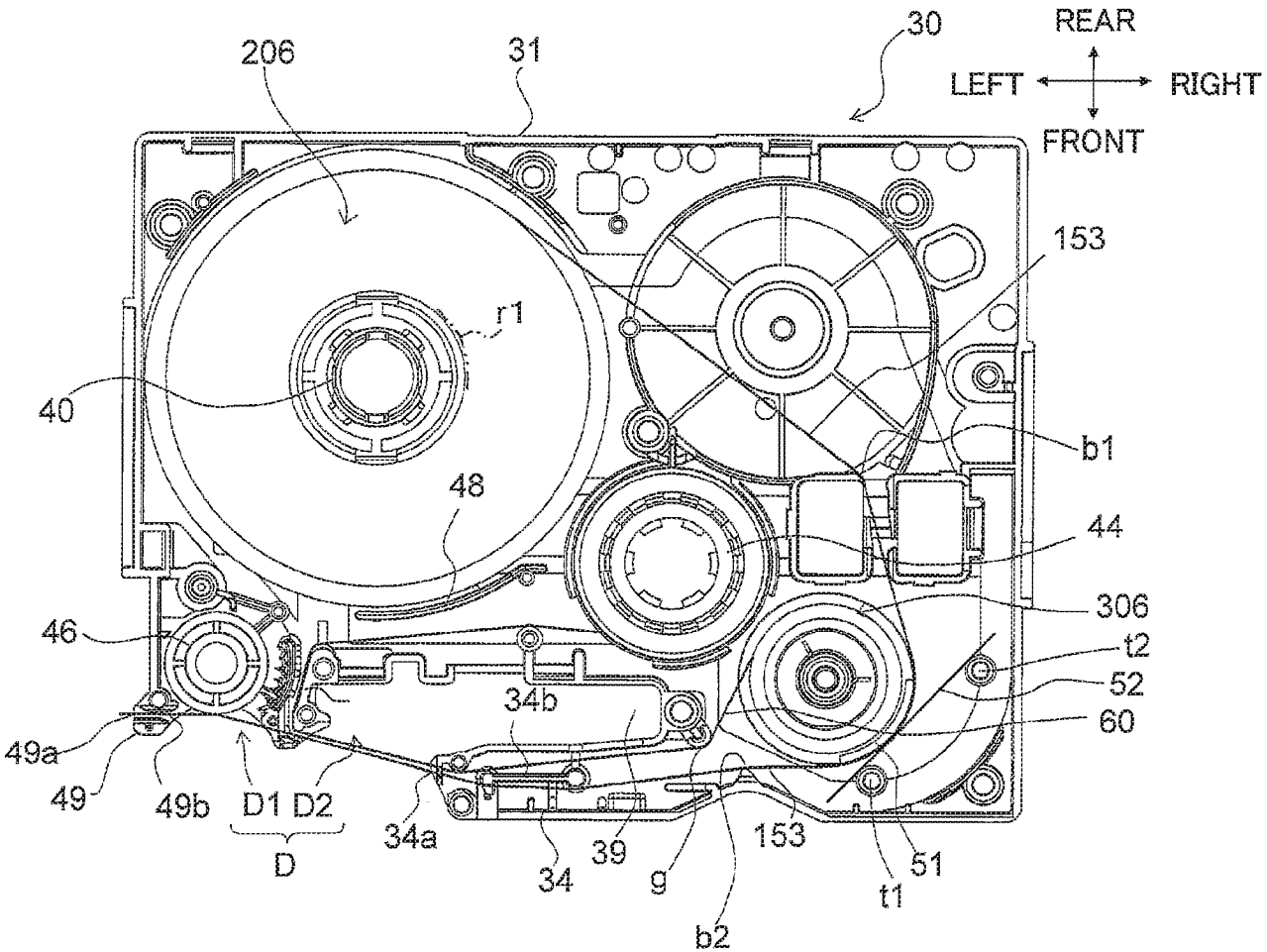
FIG. 12 is a plan view illustrating an internal configuration of the tape cartridge according to a variation in which the tape cartridge is provided with a guided member to separate the fabric tape from the ribbon roll.
Figure 13:
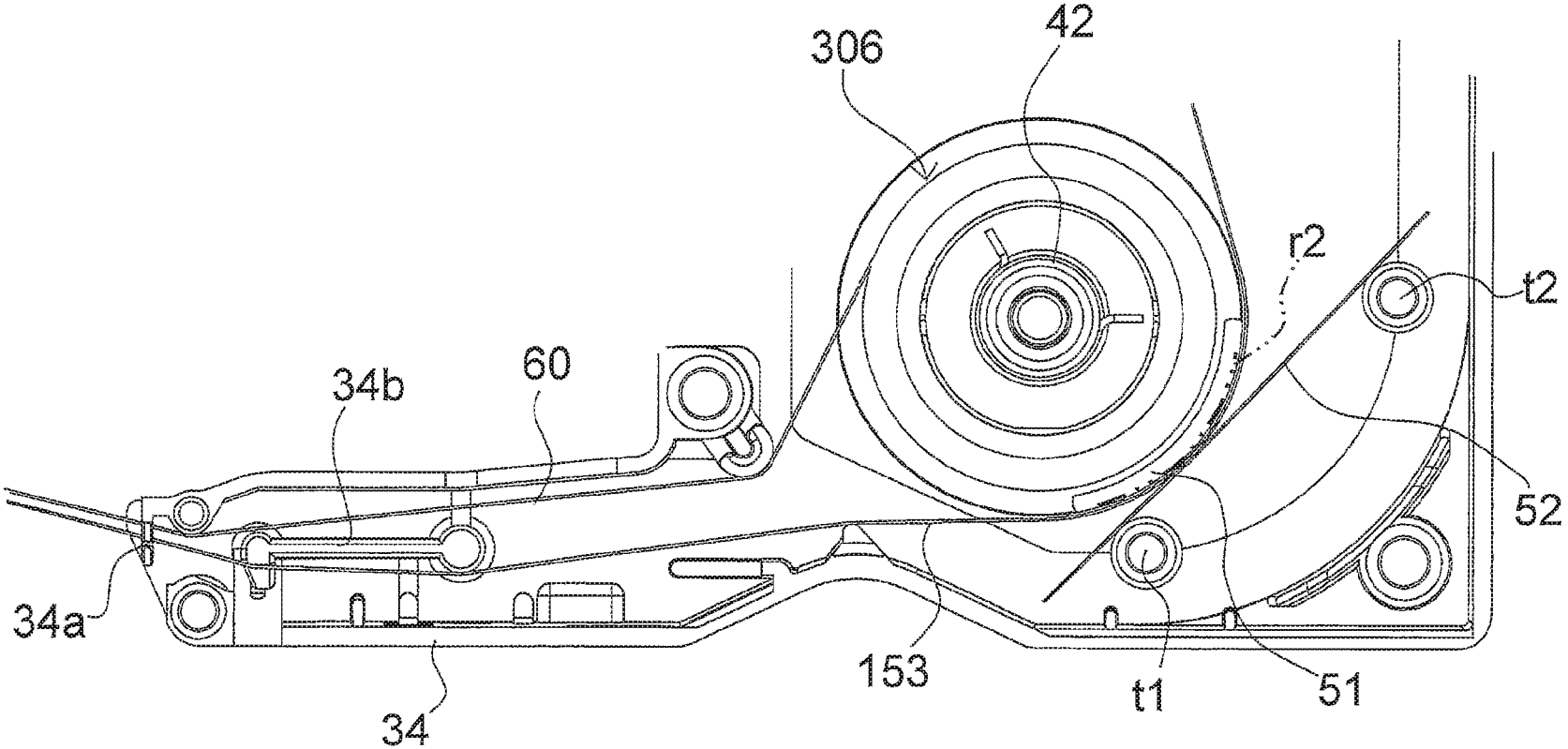
FIG. 13 is an enlarged view of the main part in FIG. 12.

FIG. 12 is an internal structural view of the tape cartridge 30 according to another variation that corresponds to FIGS. 5 and 10, and FIG. 13 is an enlarged view of the relevant region that corresponds to FIGS. 9 and 11. As shown in FIGS. 12 and 13, a guide member 51 is provided on the outer circumferential side of the ribbon roll 306. The guide member 51 is configured of a curved wall with a generally arcuate cross-section. With this construction, the fabric tape 153 drawn off the tape roll 206 is guided over the outer circumferential side of the guide member 51. In other words, the conveying path of the fabric tape 153 is separated from the ribbon roll 306. At this time, a curvature r2 (indicated by the two-dot chain line in FIG. 13) for the entire guide member 51 is greater than or equal to a curvature r1 of the tape spool 40 (and specifically, the curvature of the tape roll 206 at its minimum diameter).

A pair of support parts t1 and t2 is disposed in an upright state near the corner of the cartridge case 31 closest to the ribbon roll 306 (the right-front corner in FIGS. 12 and 13). A flat spring 52 (corresponding to the urging member) is interposed between the pair of support parts t1 and t2 and the guide member 51. With this configuration, the flat spring 52 applies an urging force to the fabric tape 153 being conveyed along the outer circumferential side of the guide member 51 for pressing the fabric tape 153 against the guide member 51.

In this variation, the guide member 51 can apply suitable tension to the fabric tape 153 when the fabric tape 153 contacts the guide member 51, thereby improving running stability during conveyance. Further, forming the guide member 51 of a continuous curved wall can reliably restrain the fabric tape 153 from coming into contact with the ribbon roll 306. Thus, the curved wall of the guide member 51 itself can apply resistance to the tape, even when the tape has a smooth surface configured of resin, film, or the like, and is particularly effective when using the fabric tape 153 having the structure described above because the fabric tape 153 is not formed of material with such smoothness. Further, setting the curvature r2 greater than or equal to the curvature r1 can at least reliably prevent the tape from becoming misshapen by being wound at a curvature smaller than the smallest possible curvature of the tape roll 206 on the tape spool 40, thereby ensuring good running stability.

By providing the flat spring 52 in this variation for constantly pressing the fabric tape 153 toward the guide member 51, the fabric tape 153 is restrained from entering excess spaces inside the cartridge case 31, and the leading end of the fabric tape 153 can be suppressed from being pulled back inside the cartridge case 31 from the tape outlet 49*a*.

Note that rather than configuring the guide member 51 of a continuous curved wall, the same effects can be achieved using a row of pins arranged in a layout similar to the outer surface of the guide member 51.

(3) Other Variations

While the arrows shown in the block diagram of FIG. 8 indicate a sample flow of signals, the directions for transmitting signals are not limited to this example.

In addition to the configurations described above, the approaches of the preferred embodiment and the variations thereof may be combined as deemed appropriate.

While not explicitly described in the above specification, various other modifications may be made to the tape cartridge without departing from the spirit of the invention.

What is claimed is:

1. A tape cartridge comprising:

a casing having a tape outlet;

a tape roll is formed by winding a fabric tape and rotatably accommodated in the casing;

a ribbon roll is formed by winding an ink ribbon and rotatably accommodated in the casing, the tape outlet being formed at a most downstream end with respect to a tape conveying path of the fabric tape discharged from the tape roll, the fabric tape being discharged through the tape outlet outside of the casing;

wherein the fabric tape includes:

a heat cutter processed part positioned at each end portion in a widthwise direction of the fabric tape; and a printing part positioned between the heat cutter processed parts, the fabric tape being in contact with an outer circumferential part of the ribbon roll on a way of conveying the fabric tape along the tape conveying path to the tape outlet.

2. The tape cartridge according to claim 1, further comprising:

a recessed section positioned along the tape conveying path and at a position upstream of the tape outlet, the recessed section providing a processing space for conveying and printing processes on the fabric tape; and a separating member positioned in the casing and separating the tape conveying path along which the fabric tape is conveyed from a ribbon conveying path along which the ink ribbon is conveyed, wherein the casing has a guide opening formed to face the recessed section and guiding the fabric tape discharged from the tape roll to the recessed section on the downstream side of the separating member.

3. The tape cartridge according to claim 1, further comprising:

a recessed section positioned along the tape conveying path and at a position upstream of the tape outlet, the recessed section providing a processing space for conveying and printing processes on the fabric tape, wherein the casing has a guide opening formed to face the recessed section and guiding the fabric tape discharged from the tape roll to the recessed section, and wherein the fabric tape converges the ink ribbon discharged from the ribbon roll at a prescribed converging position upstream of the guide opening in the tape conveying path, the fabric tape and the ink ribbon being subsequently guided toward the guide opening while remaining in contact with each other.

4. The tape cartridge according to claim 1, wherein the fabric tape is formed by satin-weaving warp threads extending in a longitudinal direction of the fabric tape, and weft threads extending latitudinal direction.

5. A tape cartridge comprising:

a casing;

a tape roll comprising a tape spool, and a fabric tape wound over the tape spool, the tape roll being rotatably accommodated in the casing;

a ribbon roll comprising a ribbon spool and an ink ribbon wound over the ribbon spool, the ribbon roll being rotatably accommodate in the casing; and a guide member provided on an outer circumferential side of the ribbon roll the fabric tape discharged from the tape roll being guided over the guide member, the guide member having a curved wall having a generally arcuate cross-section.

6. A tape cartridge comprising:

a casing;

a tape roll comprising a tape spool, and a fabric tape wound over the tape spool, the tape roll being rotatably accommodated in the casing:

a ribbon roll comprising a ribbon spool and an ink ribbon wound over the ribbon spool, the ribbon roll being rotatably accommodate in the casing; and a guide member provided on an outer circumferential side of the ribbon roll the fabric tape discharged from the tape roll being guided over the guide member, the guide member has a curvature for the entire guide member, the curvature being greater than or equal to a curvature of the tape spool.

7. A tape cartridge comprising:

a casing;

a tape roll comprising a tape spool, and a fabric tape wound over the tape spool, the tape roll being rotatably accommodated in the casing;

a ribbon roll comprising a ribbon spool and an ink ribbon wound over the ribbon spool, the ribbon roll being rotatably accommodate in the casing;

a guide member provided on an outer circumferential side of the ribbon roll the fabric tape discharged from the tape roll being guided over the guide member; and an urging member for urging the fabric tape conveyed along the tape conveying path to move toward the guide member.

8. A tape cartridge comprising:

a casing;

a tape roll comprising a tape spool, and a fabric tape wound over the tape spool, the tape roll being rotatably accommodated in the casing, the casing having a tape outlet formed at a most downstream end of a tape conveying path of the fabric tape discharged from the tape roll, the fabric tape being discharged through the tape outlet outside of the casing;

a ribbon roll comprising a ribbon spool and an ink ribbon wound over the ribbon spool, the ribbon roll being rotatably accommodate in the casing;

a guide member provided on an outer circumferential side of the ribbon roll the fabric tape discharged from the tape roll being guided over the guide member;

a recessed section positioned along the tape conveying path and at a position upstream of the tape outlet, the recessed section providing a processing space for conveying and printing processes on the fabric tape; and a separation member positioned in the casing and separating the tape conveying path along which the fabric tape is conveyed from a ribbon conveying path along which the ink ribbon is conveyed, wherein the casing further has a guide opening wherein the casing has a guide opening formed to face the recessed section and guiding the fabric tape discharged from the tape roll to the recessed section on the downstream side of the separating member.

* * * * *